US005850750A

United States Patent [19]

Cho

[11] Patent Number: 5,850,750

[45] Date of Patent: Dec. 22, 1998

[54] CLOTHES WASHER HAVING A PULSATOR APPARATUS

[75] Inventor: In-Su Cho, Kwangju, Rep. of Korea

[73] Assignee: Daewoo Electronics Co., Ltd., Rep. of Korea

[21] Appl. No.: 870,825

[22] Filed: Jun. 6, 1997

[30] Foreign Application Priority Data

Jun. 29, 1996 [KR] Rep. of Korea ..... 1996 25894

[51] Int. Cl.[6] ..... D06F 17/08; D06F 17/10

[52] U.S. Cl. ..... 68/133; 68/134; 366/292

[58] Field of Search ..... 68/133, 134; 366/292, 366/301

[56] References Cited

U.S. PATENT DOCUMENTS

| | | | |
|---|---|---|---|
| 2,076,280 | 4/1937 | Schroeder | 68/131 |
| 3,987,651 | 10/1976 | Platt | 68/133 |
| 4,018,067 | 4/1977 | Vona, Jr. et al. | 68/134 |
| 4,068,503 | 1/1978 | Platt | 68/133 |
| 4,155,228 | 5/1979 | Burgener, Jr. et al. | 68/133 |

FOREIGN PATENT DOCUMENTS

| | | | |
|---|---|---|---|
| 1125004 | 7/1956 | France | 68/133 |
| 809073 | 7/1951 | Germany | 68/131 |
| 1018384 | 10/1957 | Germany | 68/133 |
| 27320 | 6/1985 | Japan | 68/131 |

*Primary Examiner*—Philip R. Coe

*Attorney, Agent, or Firm*—Cushman Darby & Cushman Intellectual Property Group of Pillsbury Madison & Sutro, LLP

[57] ABSTRACT

In a clothes basket having a pulsator apparatus, a pulsator apparatus comprises a driving pulsator 20 disposed above a bottom portion of a clothes basket 2 and rotated by a motor 4, and a plurality of driven pulsators 30 rotated by the rotation of the driving pulsator 20 around each axis 34E of respective support shafts 34 fixed on the side wall 36 of the clothes basket 2.

6 Claims, 4 Drawing Sheets

CLOTHES WASHER HAVING A PULSATOR APPARATUS

BACKGROUND OF THE INVENTION

1. Field of the Invention

The present invention relates to a clothes washer having a pulsator apparatus, and more particularly to a clothes washer having a pulsator apparatus in which a plurality of satellite pulsators are rotated by the rotation of a sun pulsator.

2. Description of the Prior Art

A clothes washer is generally classified into either a drum type in which a rotational shaft of a water basket is horizontally arranged, or an agitator type and a pulsator type in both of which a rotating shaft of a water basket is vertically arranged.

In the drum type clothes washer, a cylindrical drum having a plurality of water extracting openings is rotatably arranged in a water basket. During operation, a plurality of projections formed in the drum pull the clothes upward, and then clothes fall by gravity so the washing process is accomplished. This washer is adapted for larger capacity washing.

In the agitator type clothes washer, a rotatable agitator mounted at the center of the clothes washer is periodically rotated, and an agitating vane formed integrally on the side wall of the agitator shakes water to form the swirling water. Clothes float in water and make frictional contact with the agitator and the inner wall of the clothes basket, thus accomplishing washing process.

In the pulsator type clothes washer, a rotatable pulsator mounted at the center of the clothes washer is rotated so the flow of water swirls, thus executing a washing operation. This washer is widely utilized at the present.

FIG. 4 illustrates the typical pulsator type clothes washer. The clothes washer is comprised of a body B, a water basket 1 suspended to the body by the suspension device (not shown), and a clothes basket 2 mounted rotatably in the water basket 1. The clothes basket 2 comprises a side wall 2S having a plurality of openings 2E, and a bottom portion 2B having a pulsator 3 rotatably mounted on the center of the bottom portion 2B. Further, beneath the water basket 1 a motor 4 and a reduction gear assembly 5 are provided. The motor 4 generates the driving force, and the reduction gear assembly 5 reduces a high speed rotational force of the motor 4 into a proper speed rotational force for both the water basket 2 and the pulsator 3. The rotation force of the motor 4 is transmitted to the pulsator 3 and/or the water basket 2 by the selective assembly or disassembly of a clutch (not shown) housed in the reduction gear assembly. The pulsator 3 is connected with an input shaft 8 projected from the reduction gear assembly 5. The clockwise or counter-clockwise rotational force of the pulsator 3 transfers to the clothes. Numeral 6 indicates a drain hose for draining water in the water basket 2, Numerals 7A, 7B are spray hoses, respectively, for spraying the pumped water from the pump onto the clothes put in the clothes basket 2. Numeral 11 designates a filter for lint in water supplied to the spray hose.

However, since single pulsator is mounted at the center of the inner bottom surface of the water basket, the water flow generated by the pulsator is sufficiently transfered to the clothes floating beneath the level of water. Additionally, an ineffective water flow is provided to the side wall of the water basket. This causes inefficient washing in respect of clothes. Also the twisting and tangling of clothes may occur.

SUMMARY OF THE INVENTION

Therefore, it is an object of the present invention to provide a clothes washer having a pulsator apparatus for improving the washing efficiency of the washer.

It is another object of the present invention to provide a clothes washer having a pulsator apparatus for sufficiently performing the anti-twisting/tangling operation of clothes.

In order to achieve the above objects of the present invention, a clothes washer having a pulsator apparatus comprises a housing; a water basket disposed in the housing for containing water; a clothes basket disposed in the water basket and comprising a bottom portion and a side wall; an operating force transmitting means mounted between the housing and the water basket for transmitting the operating force to the clothes basket; a driving pulsator fixed on a shaft extended perpendicular to the operating force transmitting means and rotatably arranged on the bottom portion in the clothes basket; and a plurality of driven pulsators operated by the driving pulsator.

Each driven pulsator is directly bevel-meshed with the driving pulsator.

Each driven pulsator is rotatably arranged with a support shaft fixed on the side wall of the clothes basket.

Further, a longitudinal center extension line of the shaft of the driving pulsator is intersected with respective longitudinal center extension lines of the support shaft of each driven pulsator in an acute angle or in a right angle.

Alternatively, the clothes washer having a pulsator apparatus in which a clothes basket is rotatably disposed in a water basket and the pulsator apparatus is rotated by a motor: the pulsator apparatus comprising a sun pulsator disposed above a bottom portion of the clothes basket and rotated by the motor; and a plurality of satellite pulsators rotated by the rotation of the sun pulsator around each axis of respective support shafts fixed on the side wall of the clothes basket.

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Hereafter, the invention will be described in further detail with reference to the accompanying drawings.

Figure 1:
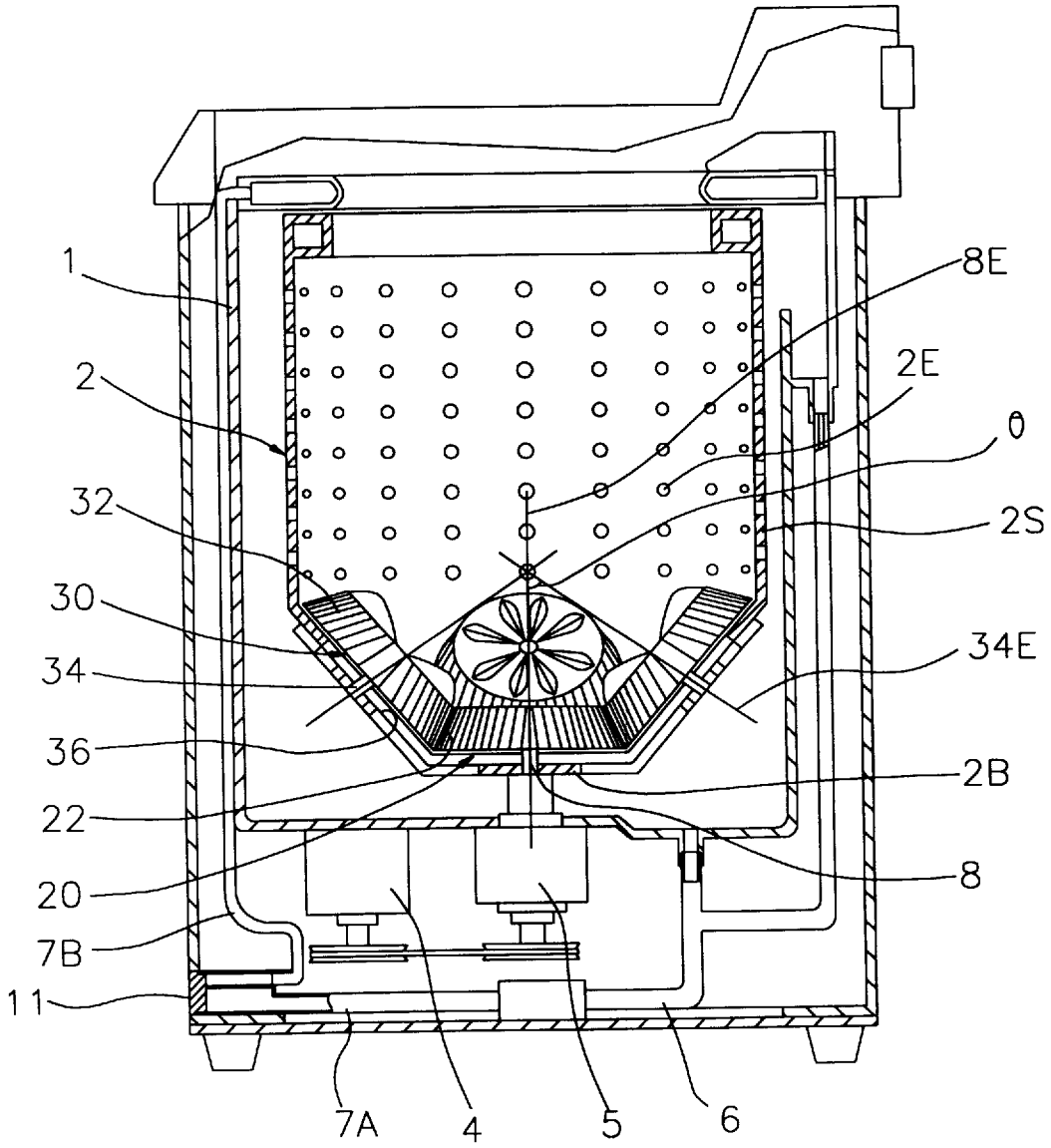
FIG. 1 is a vertical elevational view of a clothes washer having a pulsator apparatus according to the present invention.
Figure 2:
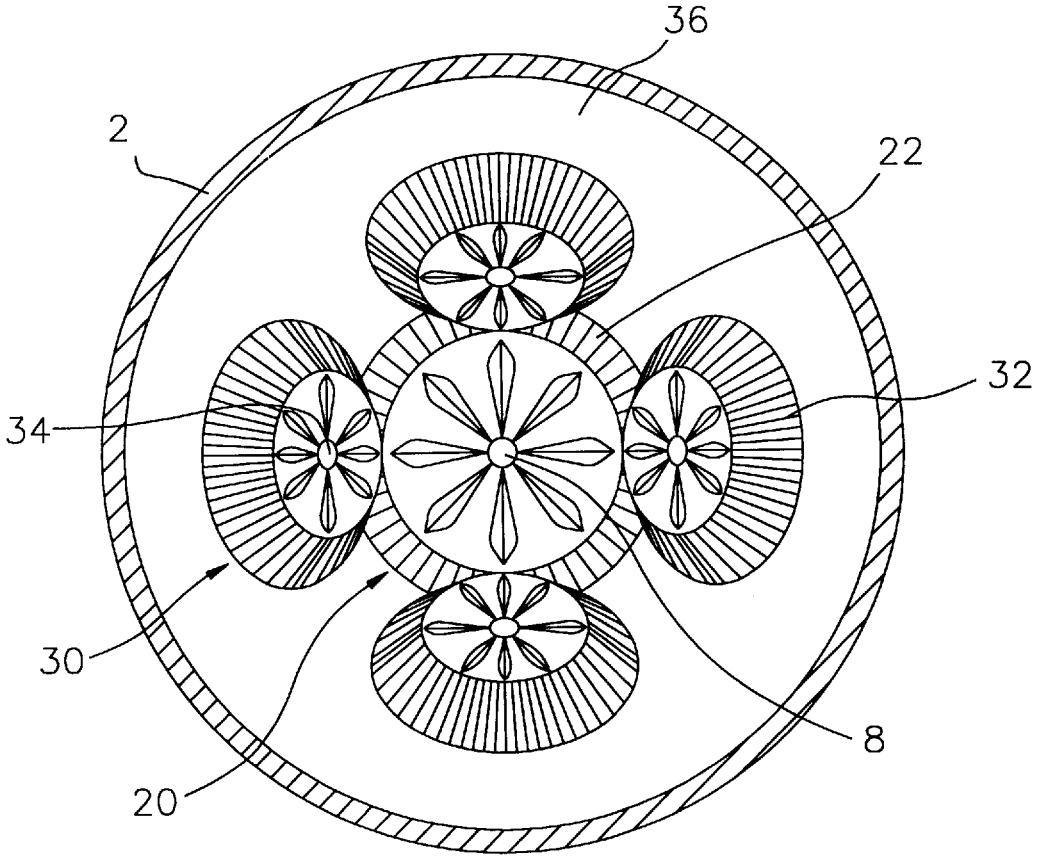
FIG. 2 is a plan view of the clothes washer having a pulsator apparatus shown in FIG. 1.
Figure 4:
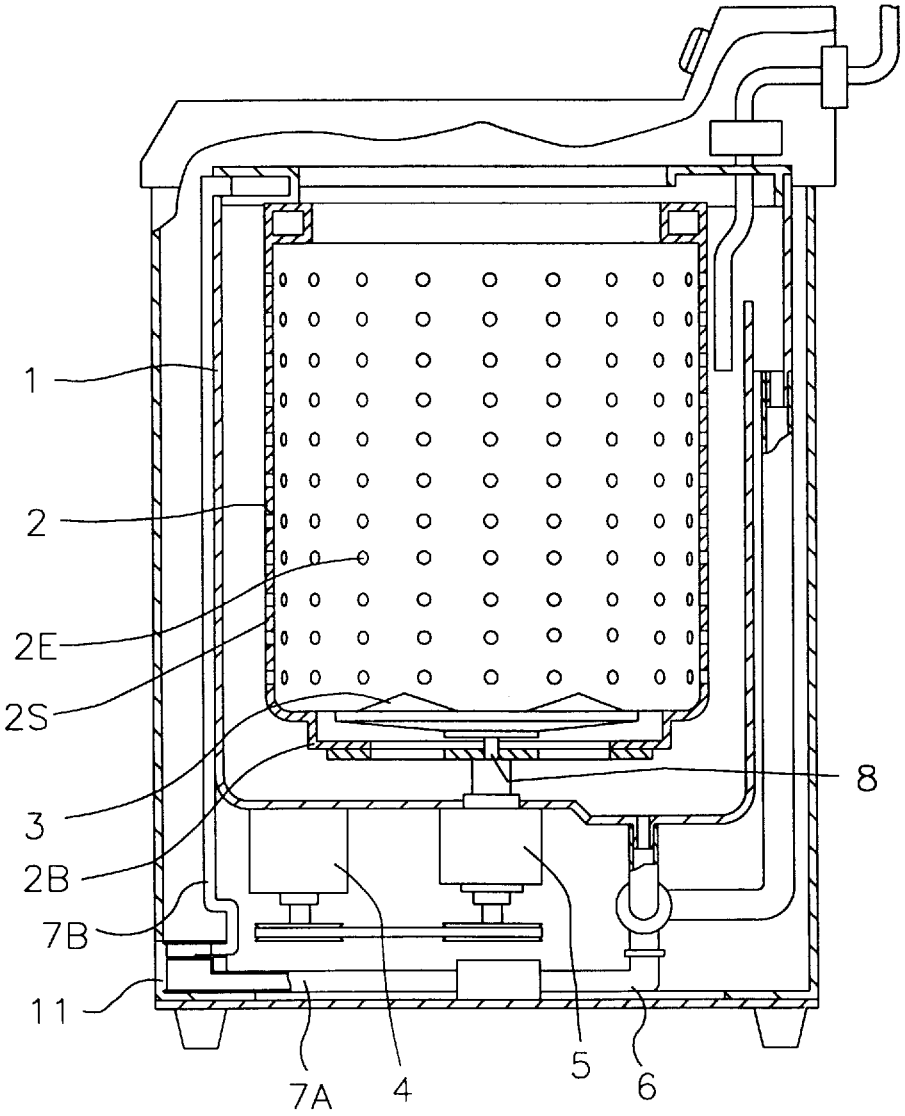
FIG. 4 PRIOR ART
FIG. 4 is a vertical elevational view of the clothes washer having a pulsator apparatus according to a prior art.

FIGS. 1 and 2 illustrate a clothes washer having a pulsator apparatus. The component parts as those in FIGS. 1 and 2 are designated by the same reference numerals as the corresponding parts of conventional embodiment of FIG. 4, so a detailed description of those parts will be omitted.

A driving pulsator 20 is rotatably mounted at the input shaft 8 of the reduction gear assembly 5 which is disposed at the central lower portion of the clothes basket 2. The driving pulsator 20 is shaped in a fruncated cone, around the slope surface of which a bevel gear 22 is formed. The driving bevel gear may have straight, curved, or spiral teeth. In this embodiment, straight teeth are employed.

A plurality of driven pulsators 30, driven by the driving pulsator 20, are displaced along the circumference of the driving pulsator 20. Each driven pulsator 30 is shaped in a fruncated cone, around the slope surface, of which a bevel gear 32 is formed. The driving bevel gear may have straight, curved, or spiral teeth. In this embodiment, straight teeth are employed for smooth meshing with the driving bevel gear 22. At a rotational center of each driven pulsator 30, a support shaft 34 is provided. The support shaft 34 is fixed perpendicular to a sloped side wall 36 which extendeds from the lower edge of the side wall 2S of the clothes basket 2. A plurality of support shafts 34 are arranged at a proper distance to each other to provide smooth meshing with the driving bevel gear 20. The quantity of the driven pulsators 30 is four in this embodiment, but four or more may be employed, if need be.

Figure 3:
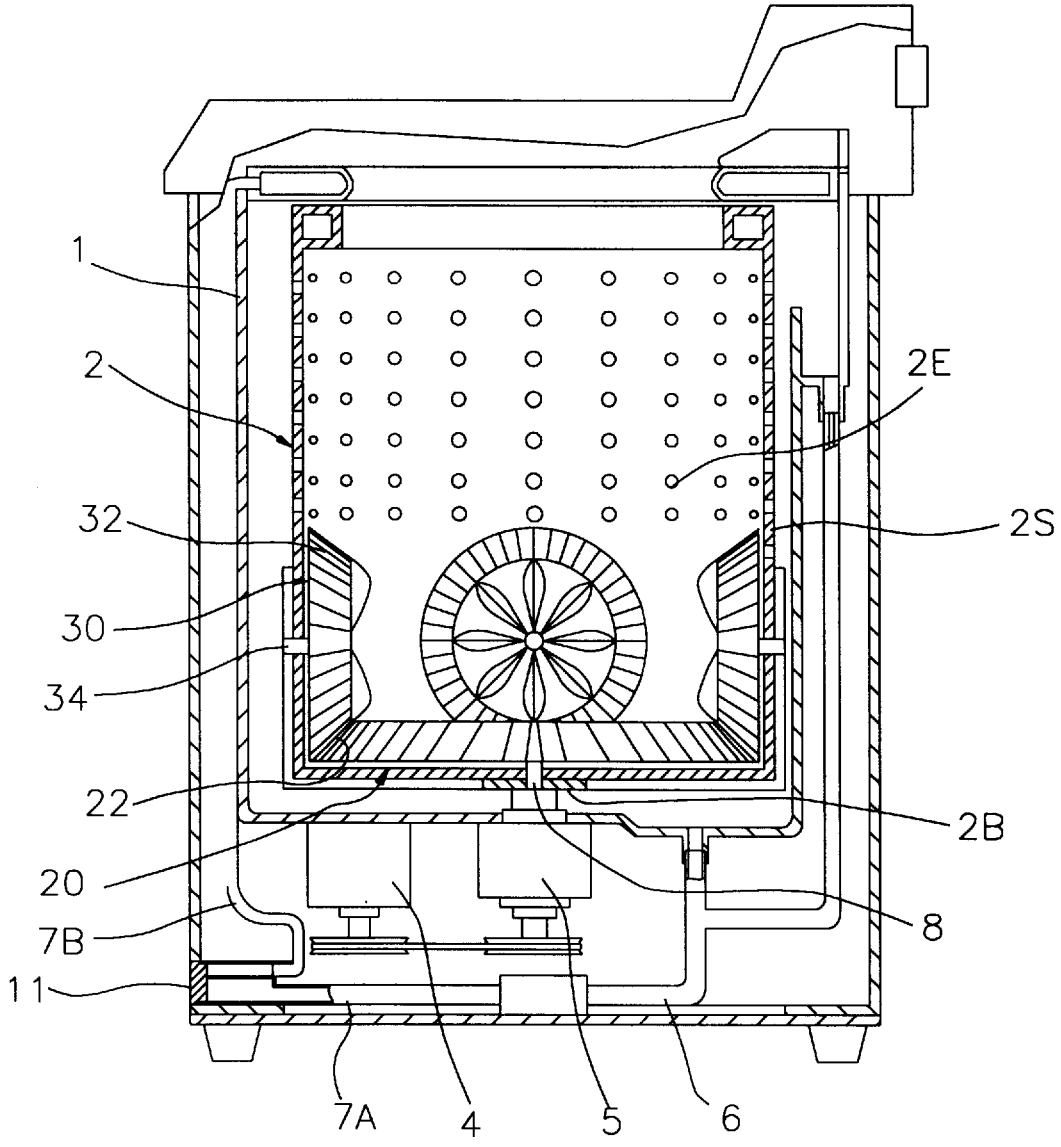
FIG. 3 is another embodiment of a clothes washer similar to FIG. 1.

A longitudinal center line 8E of the input shaft 8 inserted in the center of the driving pulsator 20 intersects with a longitudinal center line 34E of the support shaft 34 inserted in the center of each driven pulsator 30. If the angle created by two center lines 8E, 34E is defined as θ, the angle θ is an acute angle. Otherwise, when the bottom portion 2B of the clothes basket 2 forms almost a right angle with the side wall 2S, as shown in FIG. 3, each support shaft 34 of the respective driven pulsator 30 is fixed on the side wall 2S. In this case, the angle θ may be a right angle.

The clothes washer having the pulsator apparatus according to the present invention constructed as above is operated as below.

The washing mode starts according to a predetermined program, then the operating force of the motor 4 is transmitted to the reduction gear assembly 5. The input shaft 8 of the reduction gear assembly 5 rotates, and then the driving pulsator 20 rotates. The rotation of the driving pulsator 20 enables washing water to swirl around the driving pulsator 20.

Subsequently, each driven pulsator 30 meshed with the driving pulsator 20 rotates simultaneously with the rotation of the driving pulsator 20. The swirling water flow created by the rotation of each driven pulsator 30 is combined with another swirling water flow for the driving pulsator 20, which results in a greater swirling water flow. Therefore, the greater swirling water flow applies a stronger force to the clothes in the basket so that cleaner washing of the clothes can be obtained.

According to the present invention as described above, since a plurality of driven pulsators are arranged along the circumference of the driving pulsator disposed in the pulsator, and the driven pulsator are rotated according to the rotation of the driving pulsator, the driving pulsator and a plurality of driven pulsators generate a greater swirling water flow during the washing mode, resulting in higher washing efficiency.

Furthermore, since clothes in the basket are agitated by a plurality of pulsators, twisting and tangling of the clothes is prevented.

What is claimed:

1. A clothes washer having a pulsator apparatus comprising:

a housing;

a water basket disposed in said housing for containing water;

a clothes basket disposed in said water basket and comprising a bottom portion and a side wall;

an operating force transmitting means mounted between said housing and said water basket for transmitting the operating force to said clothes basket;

a driving pulsator fixed on a shaft extended perpendicular to the operating force transmitting means and rotatably arranged on said bottom portion in said clothes basket; and a plurality of driven pulsators operated by said driving pulsator.

2. The clothes washer having a pulsator apparatus according to claim 1, wherein each driven pulsator is directly bevel-meshed with said driving pulsator.

3. The clothes washer having a pulsator apparatus according to claim 1, wherein each driven pulsator is rotatably arranged with a support shaft fixed on said side wall of said clothes basket.

4. The clothes washer having a pulsator apparatus according to claim 3, wherein a longitudinal center extension line of the shaft of said driving pulsator is intersected with respective longitudinal center extension lines of said support shaft of each driven pulsator at an acute angle.

5. The clothes washer having a pulsator apparatus according to claim 3, wherein a longitudinal center extension line of said shaft of said driving pulsator is intersected with respective longitudinal center extension lines of said support shaft of each driven pulsator at a right angle.

6. A clothes washer having a pulsator apparatus in which a clothes basket is rotatably disposed in a water basket and said pulsator apparatus is rotated by a motor; said pulsator apparatus comprising a sun pulsator disposed above a bottom portion of said clothes basket and rotated by said motor; and a plurality of satellite pulsators rotated by the rotation of said sun pulsator around each axis of respective support shafts fixed on a side wall of said clothes basket.

* * * * *